US007858020B2

(12) United States Patent
Thut

(10) Patent No.: US 7,858,020 B2
(45) Date of Patent: Dec. 28, 2010

(54) MOLTEN METAL FLOW POWERED DEGASSING DEVICE

(76) Inventor: Bruno H. Thut, 16755 Park Circle Dr., Chagrin Falls, OH (US) 44023-4598

( * ) Notice: Subject to any disclaimer, the term of this patent is extended or adjusted under 35 U.S.C. 154(b) by 376 days.

(21) Appl. No.: 12/048,432

(22) Filed: Mar. 14, 2008

(65) Prior Publication Data

US 2009/0230599 A1 Sep. 17, 2009

(51) Int. Cl.

| | |
|---|---|
| ***C21B 7/00*** | (2006.01) |
| *C21B 13/06* | (2006.01) |
| *C21B 13/14* | (2006.01) |
| *C21C 7/00* | (2006.01) |

(52) U.S. Cl. ..... 266/142; 266/217

(58) Field of Classification Search ..... 266/142, 266/217; 415/93

See application file for complete search history.

(56) References Cited

U.S. PATENT DOCUMENTS

| | | | | |
|---|---|---|---|---|
| 2,651,492 | A * | 9/1953 | Feilden | 415/160 |
| 3,650,730 | A | 3/1972 | Derham et al. | |
| 3,904,306 | A | 9/1975 | Navelsaker | |
| 3,964,836 | A | 6/1976 | Navelsaker | |
| 4,052,199 | A | 10/1977 | Mangalick | |
| 4,183,745 | A | 1/1980 | Tsumura | |
| 4,921,400 | A | 5/1990 | Niskanen | |
| 4,954,167 | A | 9/1990 | Cooper | |
| 5,597,289 | A | 1/1997 | Thut | |
| 5,622,621 | A | 4/1997 | Kramer | |
| 5,662,725 | A | 9/1997 | Cooper | |
| 5,711,789 | A | 1/1998 | Elonen et al. | |
| 5,716,195 | A | 2/1998 | Thut | |
| 5,993,728 | A | 11/1999 | Vild | |
| 6,019,576 | A | 2/2000 | Thut | |
| 6,027,685 | A | 2/2000 | Cooper | |
| 6,152,691 | A | 11/2000 | Thut | |

(Continued)

FOREIGN PATENT DOCUMENTS

| | | |
|---|---|---|
| EP | 1 336 664 | 8/2003 |

(Continued)

OTHER PUBLICATIONS

Molten Metal Equipment Innovations, Gas Injection Pumps, Workhorse HF, http://www.mmei-inc.com/index_files/Page2251.htm, printed on Jan. 9, 2008.

(Continued)

*Primary Examiner*—Jessica L Ward
*Assistant Examiner*—Alexander Polyansky
(74) *Attorney, Agent, or Firm*—Pearne & Gordon LLP

(57) ABSTRACT

The invention features a molten metal flow powered device including a housing, a rotor rotatably supported by the housing, the rotor being configured and arranged to be powered by a stream of molten metal discharged from a pump, and a gas transfer conduit having an upper end adapted to engage a gas source and a lower end supported by the housing from which gas is fed to the rotor. The invention also features a pumping and degassing system that includes the pump and a source of pressurized gas. The system can also include a machine for directing flux into the pressurized gas, for passage along the gas transfer conduit to the rotor.

13 Claims, 5 Drawing Sheets

U.S. PATENT DOCUMENTS

| | | | |
|---|---|---|---|
| 6,290,900 | B1 | 9/2001 | Hatano et al. |
| 6,303,074 | B1 | 10/2001 | Cooper |
| 6,503,292 | B2 | 1/2003 | Klingensmith et al. |
| 6,533,535 | B2 | 3/2003 | Thut |
| 6,589,313 | B2 | 7/2003 | Bilodeau et al. |
| 6,629,821 | B1 | 10/2003 | Yokota et al. |
| 7,314,348 | B2 | 1/2008 | Thut |
| 2001/0000633 | A1 | 5/2001 | Rexford et al. |
| 2001/0042929 | A1 | 11/2001 | Rexford et al. |
| 2002/0185789 | A1 | 12/2002 | Klingensmith et al. |
| 2002/0185790 | A1 | 12/2002 | Klingensmith et al. |
| 2006/0180962 | A1 | 8/2006 | Thut |
| 2006/0198725 | A1 | 9/2006 | Thut |

FOREIGN PATENT DOCUMENTS

| | | |
|---|---|---|
| JP | 2118015 | 5/1990 |
| JP | 7-236961 | 9/1995 |
| JP | 7233425 | 9/1995 |
| JP | 2002-194421 | 7/2002 |
| JP | 2004-162102 | 6/2004 |

OTHER PUBLICATIONS

Molten Metal Equipment Innovations, http://www.mmei-inc.com/, printed on Jan. 9, 2008.

Virendra Warke et al., "Removal of hydrogen and solid particles from molten aluminum alloys in the rotating impeller degasser: mathematical models and computer simulations," WPI Advanced Casting Research Center—Research Programs, http://www.wpi.edu/acedemics/research/ACRC/Research/10.html, printed on Jan. 2, 2008.

Synthetic Exothermics, Tech-Injector Features, www.synex-flux.com.

* cited by examiner

MOLTEN METAL FLOW POWERED DEGASSING DEVICE

FIELD OF INVENTION

The invention pertains to injection of gas into molten metal.

BACKGROUND OF THE INVENTION

When processing molten metal such as aluminum, dissolved gases including hydrogen are removed through degassing techniques. Metals including magnesium are removed from the molten metal through demagging techniques. Gases commonly used for degassing are nitrogen and argon while gas commonly used for demagging is chlorine.

When processing molten aluminum, a bath of the molten aluminum is contained within a vessel such as a furnace. A layer of dross is formed at the surface of the molten metal bath composed of various chemical compounds such as aluminum oxide, magnesium compounds, flux and refractory particles. Some particles formed of magnesium compounds are too small to float to the surface of the bath. Chlorine gas released into the molten aluminum bath bonds with such magnesium compounds forming magnesium chloride, which can be removed from the surface of the bath. Solid fluxes of various compositions can be added to the molten metal to remove magnesium or other impurities. For example, U.S. Pat. No. 3,650,730 discloses adding solid flux containing chlorine salt instead of using chlorine gas. Adding solid flux to molten metal is dangerous because workers are near the molten metal when the flux is added. Chlorine gas is extremely toxic and chlorine gas that does not react with magnesium in the bath may enter the surrounding area creating a hazardous workplace.

The processing of molten metal commonly employs pumps that include various components depending on the application, including circulation, transfer and gas purification pumps. A gas purification pump disclosed in U.S. Pat. No. 5,993,728 to Vild, is used for injecting chlorine gas into molten metal to react with magnesium such as from aluminum can scrap. The pump includes a submerged base having an inlet opening leading to an interior impeller chamber. A discharge passageway leads from the impeller chamber to an exterior of the pump. An impeller is rotated in the impeller chamber, which draws molten metal through the inlet into the impeller chamber and out the discharge passageway. The chlorine gas is injected into the discharge passageway.

In conventional practice as shown by U.S. Pat. No. 4,052,199 to Vild, solid flux can be manually added to molten aluminum in another chamber downstream of the pump to remove magnesium prevalent in aluminum can scrap.

U.S. Pat. No. 6,589,313 discloses a hollow shaft on the end of which is an impeller. The shaft and impeller are rotated and positioned at an angle relative to the bath by a complex apparatus. Solid flux and gas is added to the rotating shaft and dispersed in the molten metal.

A device for degassing molten metal without pumping includes a motor powered vertical shaft and rotor on the end positioned in a well or location of a furnace. A source of pressurized gas is connected to the shaft. The shaft and rotor include a passageway for the gas. The spinning of the rotor disperses the gas in the molten metal.

An improved device for injecting gas into a pump for pumping molten metal is disclosed in published U.S. patent application Pub. No. 2006/0180962.

An improvement disclosed in U.S. patent application Ser. No. 11/691,664, filed Mar. 27, 2007, entitled "FLUX INJECTION WITH PUMP FOR PUMPING MOLTEN METAL," features a machine for feeding solid flux into a gas vortex for entraining the solid with the gas and directing it into molten metal discharged from a pump.

SUMMARY OF THE INVENTION

In general, the present invention features a molten metal flow powered degassing device formed of nonmetallic heat-resistant material comprising a housing, a rotor supported for rotation by the housing, the rotor being configured and arranged to be powered by a stream of molten metal discharged from a pump, and a gas transfer conduit having an upper end adapted to engage a gas source and a lower end supported by the housing from which gas is fed to the rotor.

More specifically, the housing can include bearing blocks supporting a pair of first bearing rings. The rotor extends horizontally and includes a pair of second bearing rings connected at its opposing end portions. The rotor is rotatably connected to the bearing blocks by engagement of the first and second bearing rings. One of the bearing blocks can include a socket for receiving the lower end of the gas transfer conduit, an outlet opening and a gas flow passage extending between the socket and outlet opening.

The gas may be fed to the rotor in various ways. In one design, the rotor includes a central passageway and discharge openings around its periphery that communicate with the central passageway. The outlet opening of the bearing block is in fluid communication with the central passageway of the rotor. This enables the gas leaving the passageway of the rotor to be outwardly dispersed by the rotor into the molten metal stream. In another design the rotor does not require any passageways or openings and the outlet opening of the housing is located so as to direct gas toward the outside of the rotor, such as from below it. The gas leaving the housing and directed toward the rotor, is dispersed by the rotating rotor and directed outwardly from the rotor into the molten metal stream.

The degassing device may be connected to the pump or not. In one design the device is adapted to be fastened to the pump in a path of the molten metal stream leaving the pump. In another design, the device is adapted to be fastened to a refractory wall having a lower channel and to be positioned in a path of the molten metal stream traveling through the channel. In this second design, the housing can include a sloped race configured and arranged to direct molten metal to a portion of the rotor.

A specific degassing device adapted to be fastened to a refractory wall as described above, includes the housing including bearing blocks supporting a pair of first bearing rings. One of the bearing blocks includes a socket, an outlet opening and a gas flow passage extending between the socket and outlet opening. A rotor is configured and arranged to be powered by the molten metal stream discharged by a pump. The rotor includes a pair of second bearing rings connected at its opposing end portions. The rotor extends horizontally and is rotatably connected to the bearing blocks by engagement of the first and second bearing rings. The gas transfer conduit has the upper end adapted to engage the gas source and the lower end received in the socket. The housing has the sloped race configured and arranged to direct the molten metal stream to a portion of the rotor. The housing of this device can either direct the gas through the interior of the rotor and outwardly from it into the molten metal stream, or into the rotor from outside it as described above.

A molten metal pumping and degassing system includes a submergible pump for pumping molten metal, any variation of the degassing device described above, and a source of pressurized gas. The pump includes a motor driven impeller rotatably carried on a shaft in an impeller chamber of a base. The base has an inlet opening and discharge opening in fluid communication with the impeller chamber. The impeller moves the stream of molten metal from the discharge opening of the base. The source of pressurized gas can include but is not limited to a gas selected from the group consisting of argon gas, nitrogen gas, chlorine gas and combinations thereof. The system can include a device for directing flux into the pressurized gas, for passage along the gas transfer conduit.

The invention provides many advantages compared to previous gas dispersement devices. Because the gas is released outside the pump, clogging of the pump and formation of gas pockets in the pump are avoided. In the invention the gas is dispersed by the molten metal flow powered rotor without the need for additional power. The prior art gas dispersement devices use a motor driven rotor. The invention is flexible in that there are various ways to position the degassing device in a molten metal bath including by attachment to the pump or to a refractory wall. Also, numerous types of rotors and ways to direct gas to the rotors are possible in the inventive degassing device. The invention also permits dispersing flux, along with the gas, by the spinning rotor. Finally, the gas (and optional flux) is dispersed not only by rotation of the rotor, but also as the gas rises, by the rapidly moving molten metal stream from the pump.

Many additional features, advantages and a fuller understanding of the invention will be had from the accompanying drawings and the detailed description that follows. It should be understood that the above Summary describes the invention in broad terms while the following Detailed Description describes the invention more narrowly and presents embodiments that should not be construed as necessary limitations of the broad invention as defined in the claims.

DETAILED DESCRIPTION OF THE INVENTION

Figure 1:
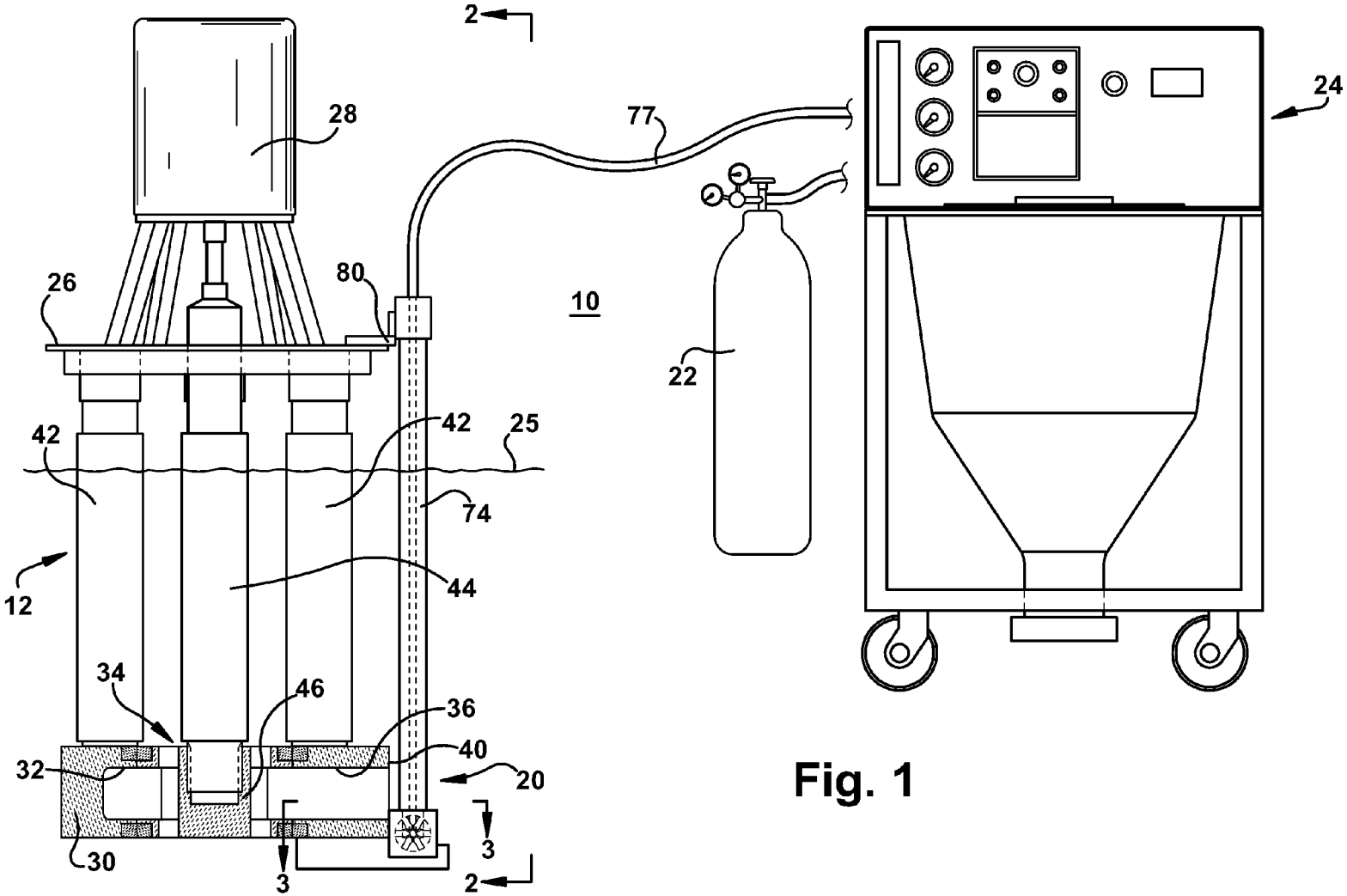
FIG. 1 is a vertical cross-sectional view of a system including a pump, flux dispersal machine, pressurized gas source, and a degassing device constructed in accordance with the present invention.

A first embodiment features a molten metal flow powered pumping and degassing system 10 including a pump 12 for pumping a stream 14 of molten metal 16 (FIGS. 1 and 6) contained in a vessel or well of a furnace (e.g., the well 18 shown in FIG. 8), a degassing device 20 positioned downstream of the pump, and a pressurized gas source 22 and solid flux delivery machine 24 disposed at a location remote from the furnace.

Figure 2:
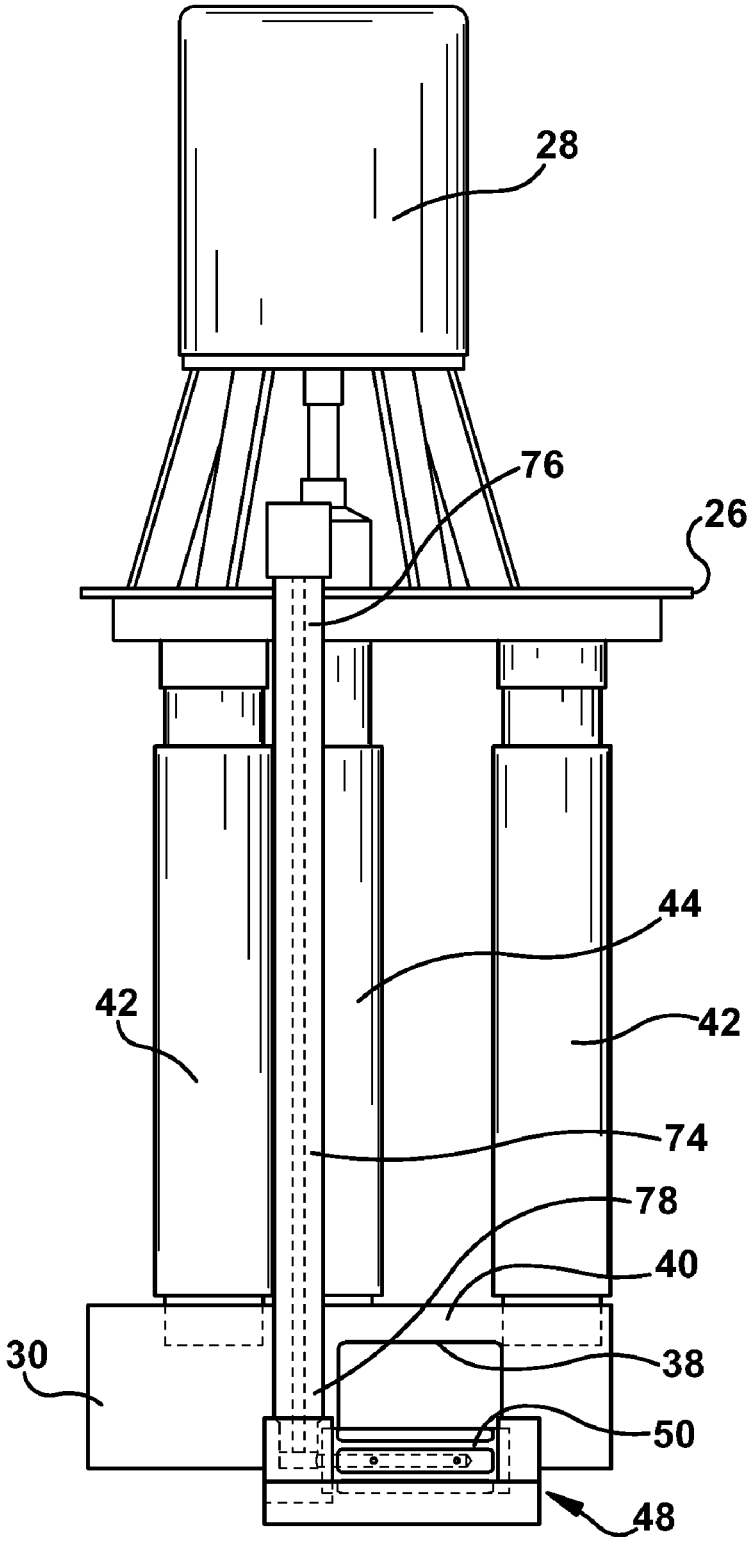
FIG. 2 is a view of the pump shown in FIG. 1 as seen along the plane 2-2 of FIG. 1.
Figure 8:
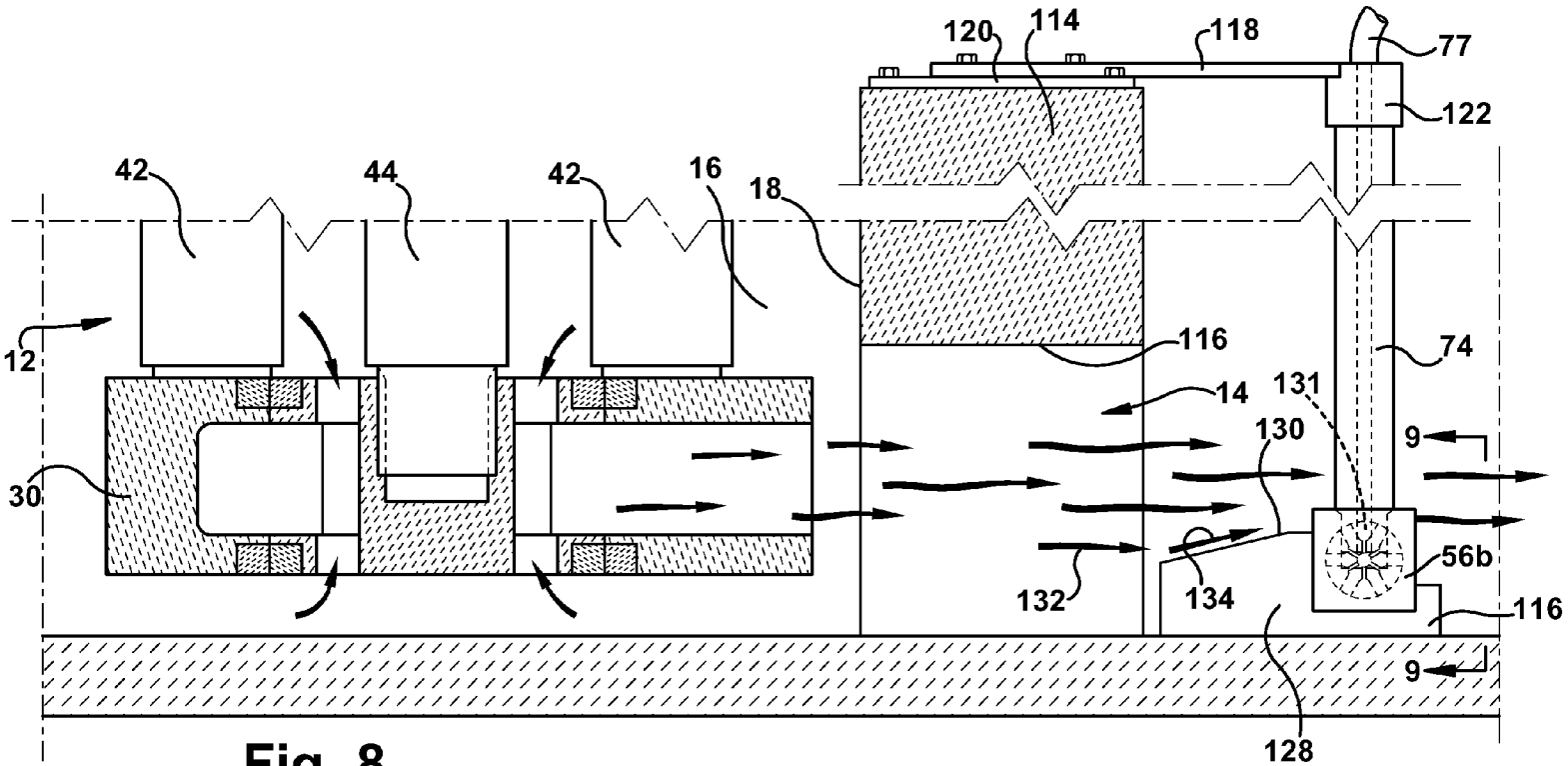
FIG. 8 is a vertical cross-sectional view of a pump and another degassing device of the invention mounted to a refractory wall.

The pump and its components are well known. A metal motor mount 26 is disposed above the surface 25 of the bath of molten metal contained in the vessel or well 18 such as a pump well of a furnace. A motor 28 is supported above the motor mount. Submerged in the molten metal is a pump base 30 that includes an impeller chamber 32. A molten metal inlet opening 34 is disposed in the base leading to the impeller chamber 32 and a molten metal discharge passageway 36 extends from the impeller chamber to an outlet opening 38 at an exterior surface 40 of the base (FIG. 2). The base is connected to the motor mount by support posts 42 that are cemented to the base and clamped to the motor mount. One of the posts may be a riser in a combination discharge/transfer pump described in U.S. Patent application Pub. No. 2006/0198725. The motor rotates a shaft 44 and impeller 46 on the end of the shaft in the impeller chamber. The impeller chamber may include a volute (as shown in FIG. 1) or can be a nonvolute chamber, both known to those skilled in the art. Rotation of the impeller in the impeller chamber moves molten metal through the inlet into the impeller chamber and from there out the discharge opening 38 of the base. The type of pump shown in FIGS. 1 and 8 is known as a discharge or circulation type of pump.

Any of numerous pumps, impellers and rotors used in such pumps, and pump and impeller components, may be used in the present invention, for example, those disclosed in U.S. Pat. Nos. 7,314,348; 6,533,535; 6,152,691; 6,019,576; 5,716,195; and 5,597,289; and in published U.S. patent application Pub. No. 2006/0198725.

Figure 3:
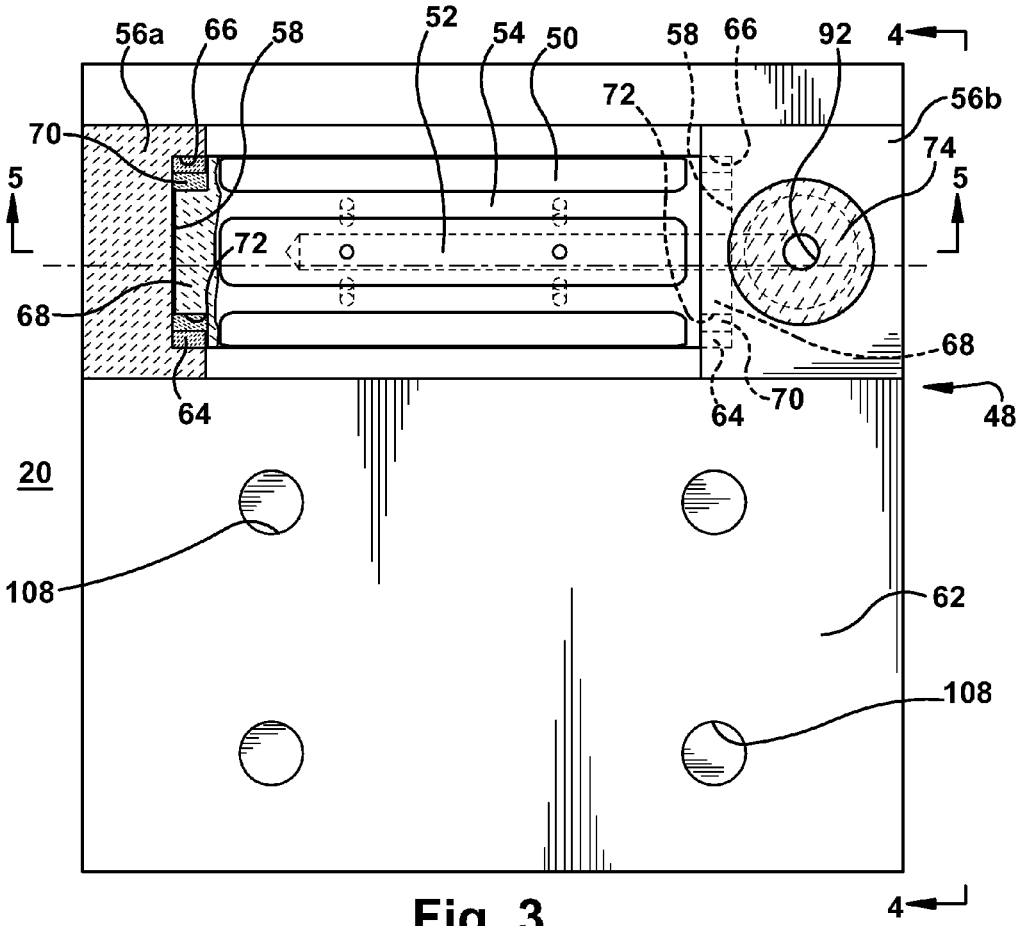
FIG. 3 is a top plan view of a degassing device of the invention as seen from the plane 3-3 of FIG. 1 (with the pump removed)
Figure 4:
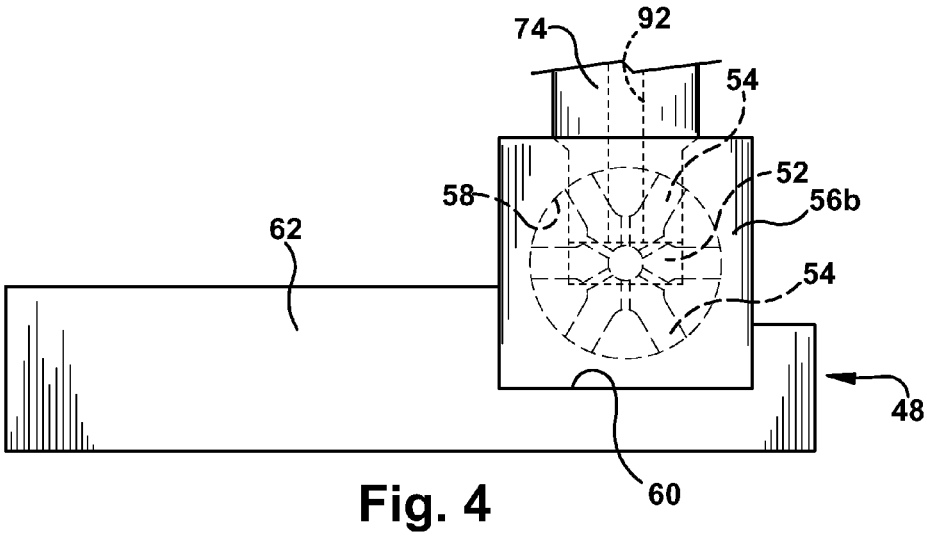
FIG. 4 is a side view of the degassing device as seen along the plane 4-4 of FIG. 3.
Figure 5:
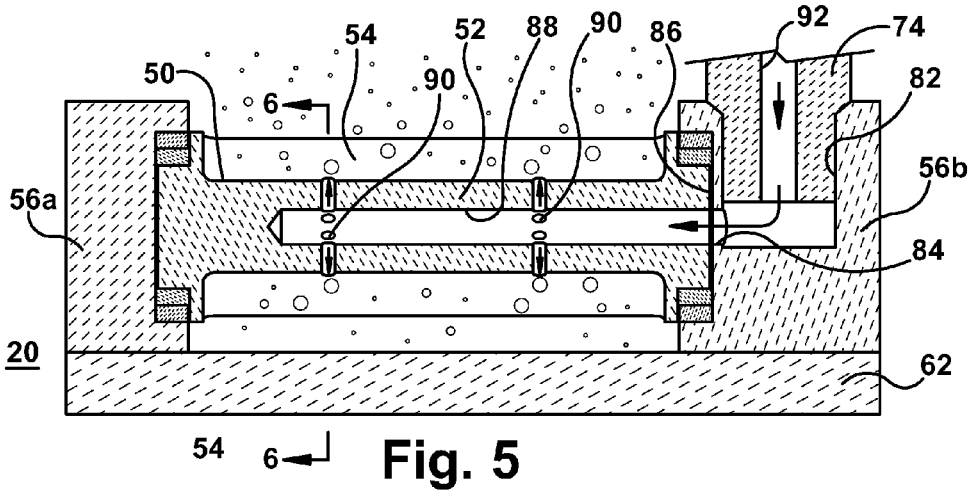
FIG. 5 is a vertical cross-sectional view of the degassing device as seen along the cutting plane 5-5 of FIG. 3.

Referring to FIGS. 3-5 the degassing device includes a housing 48 and a horizontally extending rotor 50 supported on both ends by the housing. The rotor 50 can be any type of rotor or impeller having blades, vanes and or passages enabling it to be rotated by the molten metal stream. The exemplary rotor 50 shown has features of prior art paddle wheels including an elongated central hub portion 52 and blades or vanes 54 extending outwardly therefrom. The housing 48 includes two bearing blocks 56*a, b* having circular bearing recesses 58 formed therein. The bearing blocks are received in a cavity 60 formed in a base plate 62. An outer ceramic bearing ring 64 is cemented to the outer periphery 66 of each recess. A cylindrical boss 68 extends from each end of the rotor. An inner bearing ring 70 is cemented around the peripheral surface 72 of each boss. The inner bearing rings are then fitted into the outer bearing rings and the bearing blocks are fastened to the base plate. A clearance between the inner and outer bearing rings permits rotation of the rotor.

Referring to FIGS. 1 and 2, a gas transfer conduit 74 has an upper end 76 connected to a tube 77 extending from the pressurized gas source and solid flux dispersal machine discussed below. A clamp 80 fastened to the motor mount clamps the upper end portion of the gas transfer conduit. The bearing block 56*b* includes a socket 82 in which the lower end 78 of the gas transfer conduit is cemented.

Gas can be directed to the rotor in a variety of ways as would be appreciated by one of ordinary skill in the art in view of this disclosure. For example, in one design shown in FIGS. 5 and 6, a gas passageway 84 in the bearing block leading from the socket extends to the face 86 of the bearing recess. The rotor has a central passage 88 that aligns with the passageway 84 in the bearing block. Outlet openings 90 are formed around the circumference of the rotor in fluid communication with the central passage 88. Gas travels from a passageway 92 in the gas transfer conduit 74 into the socket, into the passageway 84 of the bearing block and along the shaft passage 88 to the outlet openings 90 through which it leaves the rotor. The gas may leave the outlet openings as a stream or as the bubbles shown.

Figure 6:
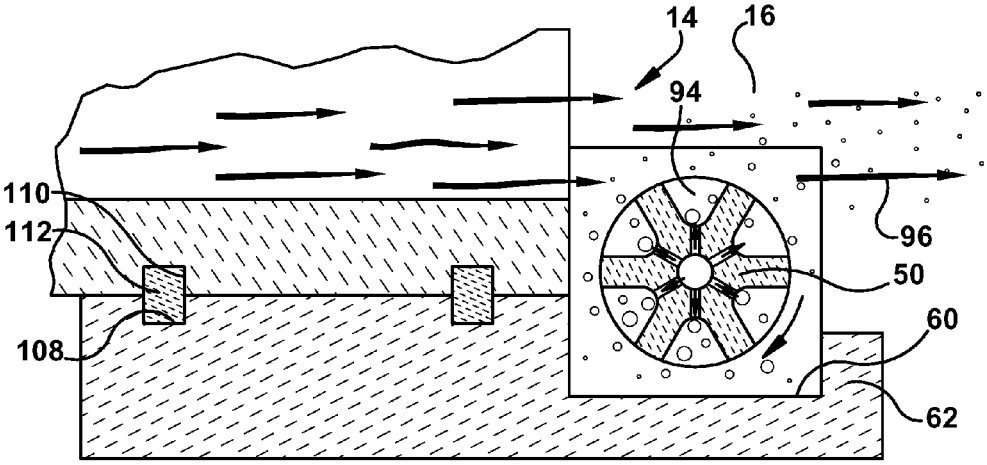
FIG. 6 is a cross-sectional view as seen from cutting plane 6-6 of FIG. 5 and shows gas dispersed by the degassing device into a molten metal stream from the pump.

The stream 14 of molten metal represented by arrows in FIG. 6 (and in FIG. 8) leaves the discharge passageway of the pump at a significant flow rate. The rotor is positioned at a location at which only an upper portion 94 of the rotor is contacted by the molten metal stream, enabling the rotor to be powered or rotated by the molten metal stream. No motor (e.g., a conventional electric or air motor) is needed to rotate the rotor of the invention. The rotor and housing may be designed so that the pressurized gas alone can rotate the rotor, so that pressurized gas contributes to rotation of the rotor by the molten metal stream, or so that pressurized gas contributes insignificantly to rotation of the rotor, as would be apparent to those skilled in the art in view of this disclosure.

Gas bubbles or streams that leave the outlet openings around the periphery of the rotor are expected to be reduced in size to small bubbles as they are impacted by the spinning blades of the rotor. Introducing the gas into the rotating rotor efficiently mixes the gas and molten metal. Also, the gas is introduced near a bottom portion of the molten metal stream, enabling it to pass upward through the entire height of the rapidly moving molten metal stream, leading to better mixing of the gas and molten metal.

Figure 7:
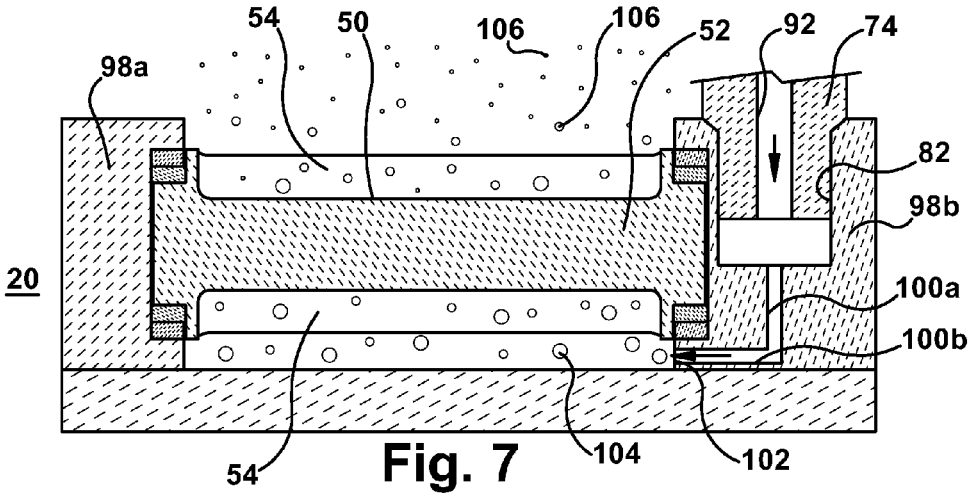
FIG. 7 is a variation of the degassing device shown in FIGS. 5 and 8 as seen from a cutting plane located in the same position as the cutting plane 5-5.

Another way in which the gas can be introduced to the rotor is shown in FIG. 7. The figures in this disclosure use like reference numerals for the same parts throughout the views. The bearing block 98*b* of this design is the same as the bearing block 56*b* in FIG. 5 except that there is no passageway or aligned rotor passageway, but only a passageway in the bearing block having vertical and horizontal portions 100*a,b* leading below the rotor. The vertical passageway portion 100*a* is in fluid communication with the socket 82 and leads to the horizontal passageway portion 100*b* having an outlet opening 102 positioned to release gas bubbles 104 or a gas stream below the impeller. In this design the gas is fed from outside the rotating rotor into it. Rotation of the rotor is expected to reduce the size of the bubbles or stream of gas released from the bearing block into small bubbles 106. Introducing the gas into the rotating rotor from below it efficiently mixes the gas and molten metal. Also, the gas is introduced near the bottom 96 of the molten metal stream, enabling it to pass upward through the entire height of the rapidly moving molten metal stream, leading to better mixing of the gas and molten metal of the bath. Other ways of introducing the gas to the rotor will be apparent to those skilled in the art in view of this disclosure.

The degassing device can be fastened to the pump base or not. In the design of FIGS. 1-6 the degassing device is connected to the pump. The base plate 62 has holes 108. Corresponding holes 110 are formed in a lower surface of the base. The holes of the base plate and pump base are aligned and pins 112 are cemented in them to connect the degassing device to the pump base. The base plate rests on the floor of the furnace and has a height that enables the pump to be spaced from the bottom of the furnace by a suitable distance known in the art (FIG. 1).

Figure 9:
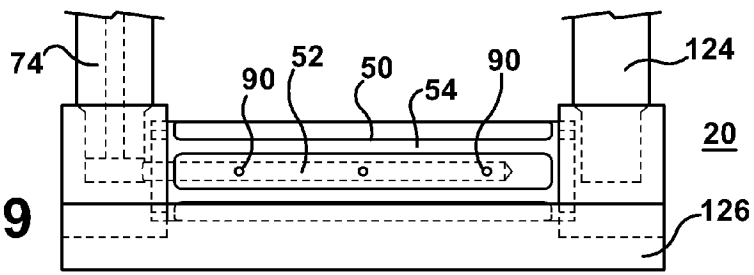
FIG. 9 is a view as seen along the plane 9-9 of FIG. 8.

A design in which the degassing device is not connected to the pump is shown in FIGS. 8 and 9. The pump 12 is the same as discussed in FIG. 1 (a spacer that can be disposed between the pump base and furnace floor not being shown). A refractory wall 114 located in the molten metal bath includes an archway or channel 116 at a lower portion of the wall. An upper plate 118 is fastened to an upper surface of the wall. This upper wall surface may be a refractory surface of the wall or is formed by a steel sill plate 120 on top of the refractory wall. Two sockets 122 extend downwardly from the plate 118 (only one socket being seen in FIG. 8). A support post 124 and the gas transfer conduit 74 are connected to the sockets 122 at their upper end portions as with threads.

The housing 126 shown in FIG. 8 is the same housing as the housing 48 shown in FIGS. 5 and 3 except that instead of the lower base plate 62, the housing includes a base 128 resting on the floor of the furnace having an upwardly inclined race 130. The race is positioned at a height above the floor of the furnace, at an angle and length that directs the molten metal stream passing through the channel to an upper portion 131 of the rotor. Lower portions 132 of the molten metal stream 14 are deflected by the race and travel in the general direction shown by the arrow 134, powering the rotor as they impact the rotor upper portion.

The design shown in FIG. 7 can be used in a degassing device that is attached to the pump as in FIGS. 1-6 or that is not attached to the pump as in FIGS. 8 and 9. When connected to the refractory wall, the FIG. 7 device would include the housing 126 with the race 130 as in FIG. 8, while when fastened to the pump the design would include the base plate 62 shown in FIG. 3 for fastening to the bottom of the pump base.

The source of pressurized gas 22 used in the present invention can include but is not limited to the following gases alone or in combination: argon, nitrogen, and chlorine gases.

Any composition of flux that can be directed along a gas stream is suitable for use in the invention, for example, solid flux available from the company, Synex, Inc. and disclosed in its website www.synex-flux.com. Any device that can direct flux into a stream of gas for passage along the gas transfer conduit can be used in the invention. One suitable machine 24 for delivering solid flux into a stream of pressurized gas is disclosed in the Ser. No. 11/691,664 application, which is incorporated herein by reference in its entirety. This flux delivery machine 24 is sold by the company, Synex, Inc. and described by its brochure on the website www.synex-flux-.com, which is incorporated herein by reference. The terms flux solids used herein mean flux in a form selected from the group consisting of powder, granulation, pellets and combinations thereof. The invention may permit using flux solids comprising a chloride containing compound and pressurized gas without chlorine. A suitable flux is one that can bond to magnesium enabling it to be removed from the molten aluminum bath. The tube 77 can be comprised of metal and flexible portions. If no flux is used the tube 77 is connected to tube 136 from a pressurized gas source 22. For a discussion of interconnection of the pressurized gas source, solid flux delivery machine 24 by Synex Inc. and tube 77 leading to a refractory conduit, see the Ser. No. 11/691,664 application. Other connections of flux delivery devices, pressurized gas sources and tube 77 would be apparent to one of ordinary skill in the art in view of this disclosure. All of the components of the pumping and degassing system that contact the molten metal are formed of refractory material such as ceramic or graphite, and components above and in the vicinity of the molten metal can be formed of steel.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A molten metal pumping and degassing system comprising:

a submergible pump for pumping molten metal including a motor driven impeller rotatably carried on a shaft in an impeller chamber of a base, said base having an inlet opening and discharge opening in fluid communication with said impeller chamber, said impeller moving a stream of molten metal from said discharge opening of said base; and a molten metal flow powered device positioned in said stream of molten metal, said device being formed of nonmetallic heat-resistant material comprising a housing, a rotor supported for rotation by said housing, said rotor being configured and arranged to be powered by the stream of molten metal, a gas source which is a tank containing pressurized gas and a gas transfer conduit having an upper end engaged with said gas source and a lower end supported by said housing, said housing including a gas flow passageway leading from said lower end of said conduit from which gas is fed through an interior of said rotor or in contact with an exterior surface of said rotor, whereby said gas is mixed in said molten metal by said rotor that is powered by the stream of said molten metal.

2. The system of claim 1 wherein said housing is fastened to said base.

3. The system of claim 1 wherein said housing is fastened to a refractory wall having a lower channel which positions said rotor in a path of the stream of molten metal traveling through said channel.

4. The system of claim 1 wherein said pressurized gas is selected from the group consisting of argon gas, nitrogen gas, chlorine gas and combinations thereof.

5. The system of claim 4 comprising a device adapted to direct flux into the pressurized gas for passage along said gas transfer conduit.

6. The system of claim 1 wherein said housing includes bearing blocks supporting a pair of first bearing rings, said rotor extends horizontally and includes a pair of second bearing rings connected at opposing end portions of said rotor, and said rotor is rotatably connected to said bearing blocks by engagement of said first and second bearing rings.

7. The system of claim 6 wherein one of said bearing blocks includes a socket for receiving the lower end of said conduit, and said gas flow passageway extends from said socket.

8. The system of claim 7 wherein said rotor includes a central passageway and discharge openings around its periphery that communicate with said central passageway, said gas flow passageway being in fluid communication with said central passageway of said rotor.

9. The system of claim 1 wherein said housing comprises a sloped race configured and arranged to direct molten metal to a portion of said rotor.

10. The system of claim 7 wherein said gas flow passageway leads to an outlet opening located so as to direct gas toward the exterior surface of said rotor.

11. The system of claim 7 wherein said housing has a sloped race configured and arranged to direct the molten metal stream to a portion of said rotor.

12. The system of claim 11 wherein said housing is fastened to a refractory wall having a lower channel which positions said rotor in a path of the molten metal stream traveling through said channel.

13. The system of claim 11 wherein said rotor includes a central passageway and discharge openings around its periphery that communicate with said central passageway, said gas flow passageway being in fluid communication with said central passageway of said rotor.

* * * * *